United States Patent [19]

Roodenburg et al.

[11] Patent Number: 5,009,412

[45] Date of Patent: Apr. 23, 1991

[54] EATHQUAKE SIMULATOR FOR A THEME PARK

[75] Inventors: Joop Roodenburg, Delft; Hendrik F. Roodenburg, Krimpen A/D Ijssel, both of Netherlands

[73] Assignee: Itrec B.V., Rotterdam, Netherlands

[21] Appl. No.: 438,267

[22] Filed: Nov. 16, 1989

[30] Foreign Application Priority Data

Nov. 16, 1988 [NL] Netherlands ..... 8802827

[51] Int. Cl.[5] ..... A63G 31/00

[52] U.S. Cl. ..... 272/2; 272/1 R; 272/8 R

[58] Field of Search ..... 272/10, 1 R, 2, 16, 272/17, 18, 8 R; 52/167

[56] References Cited

U.S. PATENT DOCUMENTS 694,447 3/1902 van Kannel ..... 272/2 X 953,724 4/1910 van Kannel ..... 272/2 X 2,166,577 7/1939 Beckius ..... 272/2 X

*Primary Examiner*—Richard E. Chilcot, Jr.

*Attorney, Agent, or Firm*—Bachman & LaPointe

[57] ABSTRACT

In order to give a relatively large number of people, for example twenty-five to sixty people, the sensation of experiencing an earthquake, without those people running any risk, an earthquake simulator for a theme park comprises a platform 1 on which at least twenty-five chairs 5 provided with safety straps or seat belts are fixed, an underframe 4, and at least three hydraulic cylinders 2, 3 which are fixed between fastening eyes of the underframe and of the platform by means of ball bearings or universal joints, in such a way that the platform can move with at least three independently driven degrees of freedom. Said cylinders form part of a hydraulic circuit whose valves can be controlled by a programmed microprocessor.

9 Claims, 2 Drawing Sheets

EATHQUAKE SIMULATOR FOR A THEME PARK

The invention relates to an earthquake simulator for a theme park.

The object of the present invention is to produce a simulator on which a relatively large number of persons (for example, 25 to 60 persons) can be seated, and given the impression of experiencing an earthquake, without being in any danger.

According to the invention, the simulator comprises a platform on which at least 25 chairs with safety straps or seat belts are fixed, an underframe, and at least three hydraulic cylinders which are fixed between fastening eyes of the underframe and of the platform by means of ball bearings or universal joints, in such a way that the platform can move with at least three independently driven degrees of freedom, the hydraulic cylinders forming part of a hydraulic circuit whose valves can be controlled by a programmed microprocessor.

In order to be able to move the platform independently with six degrees of freedom in three directions (x, y and z) at right angles to each other, in a preferred embodiment provision is made between the underframe and the platform for three essentially vertical hydraulic cylinders arranged in a triangle and three essentially horizontal cylinders, two of which extend essentially parallel to each other, while the third runs at right angles thereto.

Each cylinder can be operated independently of the others, during which the reciprocating movement of the piston rod has a negligible influence on the reciprocating movement of the piston rod of the other five cylinders.

Universal joints are very satisfactory, but they are expensive. Ball bearings are therefore preferred. It is necessary to avoid statically indeterminate situations. With the use of ball bearings, it must be ensured on this account that rotation about an axis which coincides with or runs parallel to the central axis of the particular hydraulic cylinder is prevented. Each ball bearing is therefore provided with a wheel which is guided between two guide plates connected to the platform or the underframe.

In order to minimize the amount of energy required to move the platform, the piston rod of each of the vertical hydraulic cylinders projects into a cylinder which is connected to a pressure vessel in which oil can be brought to high pressure by a compressed gas (nitrogen).

One or more buildings which can undergo a full or partial collapse movement are simulated on the platform. Other provisions connected with sound effects, light and smoke can also be added.

The invention will now be explained in greater detail with reference to the figures, in which an example of an embodiment is shown.

Figure 1:
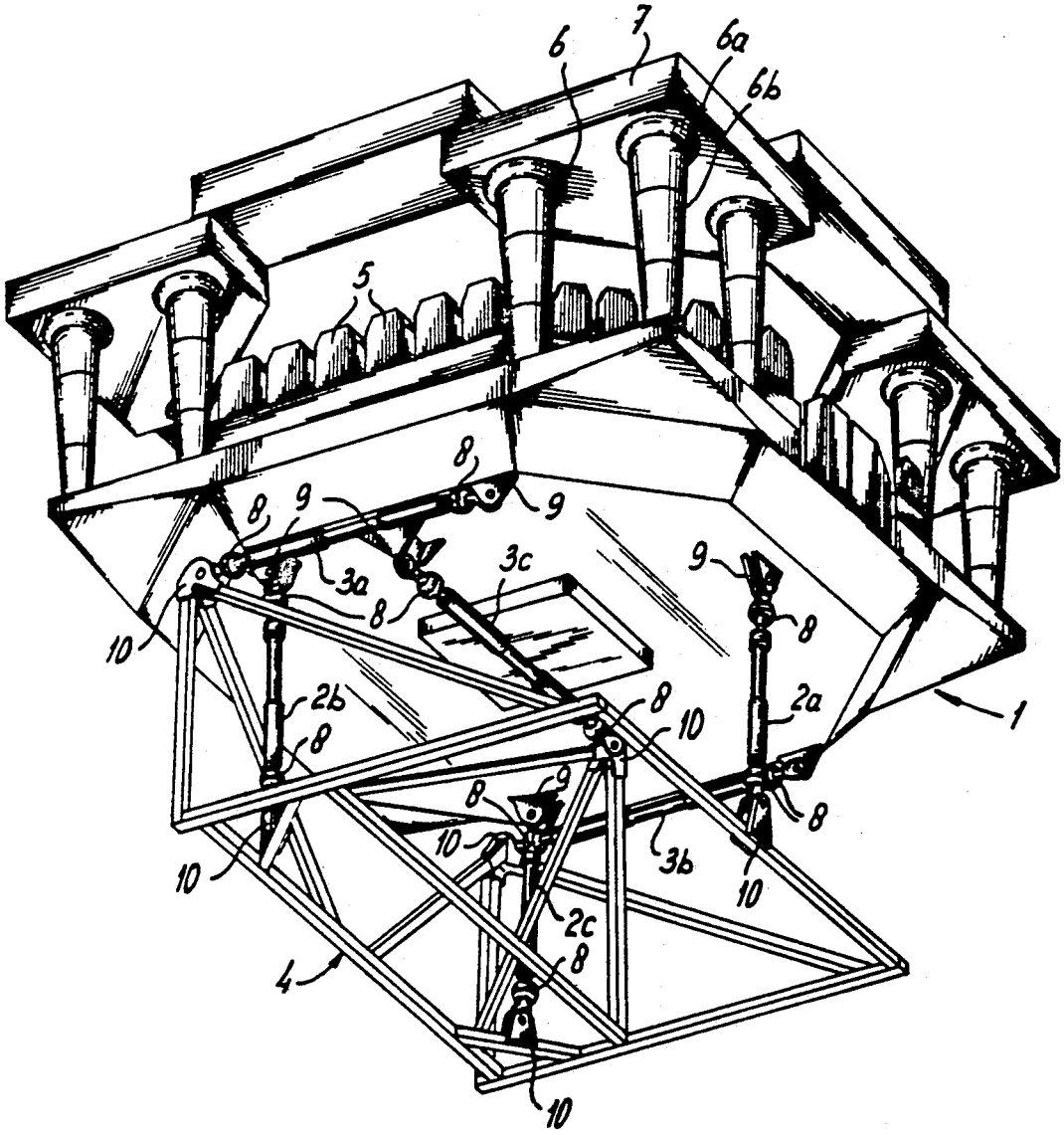
FIG. 1 shows a perspective view of the bottom side of the earthquake simulator, in which part of the underframe is cut away.

The earthquake simulator shown comprises a steel platform 1 which is supported via three vertical hydraulic cylinders 2a, 2b, 2c by an underframe 4. Three horizontal hydraulic cylinders 3a, 3b, 3c are also placed between the platform 1 and the underframe 4. The term hydraulic cylinder also covers an assembly of cylinders coupled together and working in the same direction.

The underframe is placed in a hole in the ground, in such a way that the platform 1 lies approximately at ground level.

A number (for example, approximately 50) of chairs 5 are fixed on the platform, and near the rows of chairs, which can be placed at different levels, a building is simulated, in the case shown a temple with columns 6 and roof or ceiling parts 7 supported thereon.

The vertical cylinders 2a, 2b, 2c are arranged in such a way in a triangle that the centre of gravity of the platform coincides approximately with the centre of gravity of the triangle. Two horizontal hydraulic cylinders 3a and 3b are parallel to each other, and the third horizontal hydraulic cylinder 3c extends at right angles to the first two. The vertical cylinders 2a, 2b, 2c take care of the vertical movements and tilting movements about two horizontal main axes.

The connections between the hydraulic cylinders and the platform 1 and the underframe 4 permit pivoting movements in two turning directions which are at right angles to each other. These connections can be universal joints, but ball bearings are preferably used.

The placing of the cylinders and the above-mentioned hinge joints is selected in such a way that the platform can be moved with six degrees of freedom independently in the x, y and z direction, during which the platform can tilt about the x-axis, y-axis and z-axis.

Figure 2:
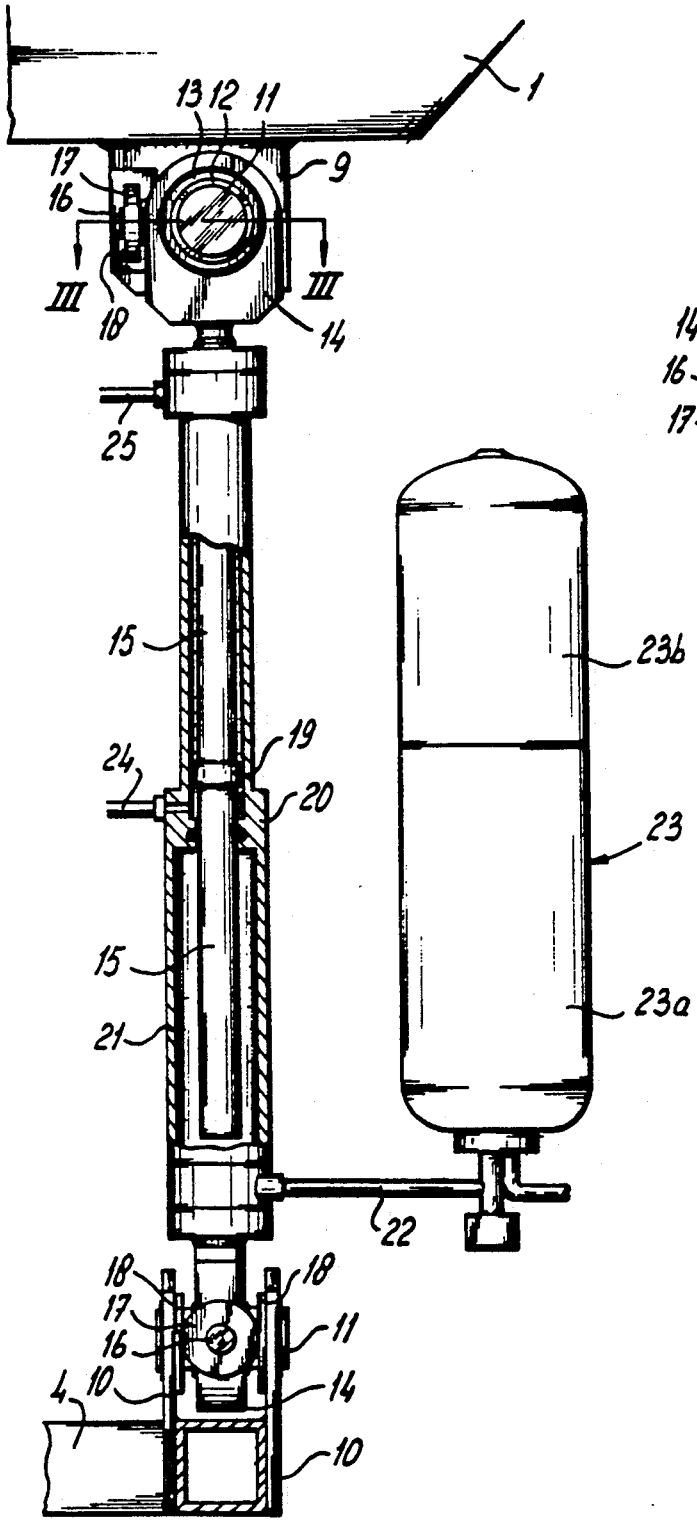
FIG. 2 shows a view partially in cross section of a vertical hydraulic cylinder which is used in the simulator.
Figure 3:
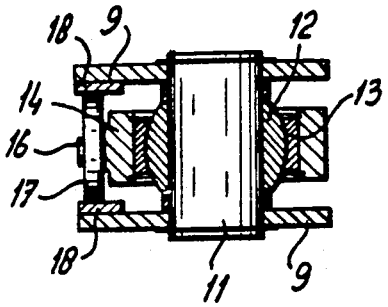
FIG. 3 shows a cross-section along the line III—III in FIG. 2.

For the design of the ball bearings you are referred to FIGS. 2 and 3. Fixed to the ears 9 of the platform is a shaft 11 which is provided on its periphery with a ball element 12. This ball element projects into a dish 13 which is fixed by means of an eye 14 to the head of the piston rod 15. A wheel 17, which is guided by two guide plates 18 welded on the ears 9, is mounted on the eye 14 via a journal 16. The wheel 17 and the plates 18 prevent the piston rod 15 and the hydraulic cylinder 2 from rotating at an arbitrary angle relative to each other. This could lead to undesirable statically indeterminate situations.

The piston rod 15, which is connected to the piston 19, extends further on the other side of the piston beyond the cover 20 of a second cylinder 21, which is connected by means of a pipe 22 to an accumulator 23, which contains oil in the bottom part 23a and nitrogen placed under high pressure in the top part 23b. The oil placed under high pressure by means of the nitrogen loads the bottom face of the piston rod 15 upwards. The weight of the platform is thus taken by the nitrogen pressure, by means of the three vertical hydraulic cylinders. Oil is fed in and discharged through the pipes 24 and 25 to slide out the piston rod 15. The energy required for this is minimized.

The bottom side of the cylinder 21 is connected in the same way by means of a ball bearing to two ears 9 of the underframe 4.

The horizontal cylinders 3a, 3b and 3c are also connected by means of ball bearings to ears 9 and 2 of the platform 1 and the underframe 4 respectively. There is no nitrogen accumulator or second cylinder 21 in the case of these horizontal hydraulic cylinders.

The pipes 24 and 25 of each cylinder 2a, 2b, 2c and 3a, 3b, 3c form part of a hydraulic circuit whose valves are controlled by a programmed microprocessor.

In a design of the earthquake simulator built according to the invention, the translation accelerations are more than 4 meters per second squared, and the amplitudes are at least 0.3 meter.

The chairs fixed in rows at various levels on the platform are provided with safety straps which cannot be opened by the persons sitting on the chairs during operation of the simulator.

The columns 6 are made up of various annular pieces 6*a*, 6*b* which can rotate eccentrically about a central inner axis. The bottom ring is, for example, fixed to the platform. The roof and ceiling parts 6 are fixed by means of sturdy hinges to the top ends of the columns 6, and can carry out a tilting movement within certain limits. Sound and smoke effects can reinforce the illusion of an earthquake.

We claim:

1. An earthquake simulator for a theme park which comprises:

a platform having a plurality of chairs securely attached thereto, said chairs provided with safety straps, and ears affixed to the platform;

an underframe spaced from the platform having ears affixed thereto;

at least three substantially vertical hydraulic cylinders having opposed ends, arranged in a triangle with one end of each cylinder affixed to the ears of the platform and with the opposed end affixed to the ears of the underframe;

means for movably attaching each hydraulic cylinder between an ear on said platform and an ear on said underframe; and means for providing pressurized oil to said hydraulic cylinders, wherein the platform is movable with at least three independently driven degrees of freedom.

2. An earthquake simulator according to claim 1 wherein said means for movably attaching comprises a universal joint attached between an end of said hydraulic cylinder and an ear on said platform, and another universal joint attached between the opposite end of said hydraulic cylinder and an ear on said underframe.

3. An earthquake simulator according to claim 1 wherein said means for movably attaching comprises a hinge joint attaching an end of said hydraulic cylinder to the ear of said platform, and another of said hinge joints connecting the opposite end of said hydraulic cylinder to the ear on said underframe;

said hinge joint comprising a ball bearing projecting into a cup, and said cup is connected to an eye which is attached to an end of said hydraulic cylinder, and guide plates connected to an ear of one of said ear on the platform and said ear on the underframe, and a wheel guided by said guide plates attached to said eye via a journal.

4. An earthquake simulator according to claim 1 further comprising at least two substantially horizontal hydraulic cylinders extending substantially parallel to one another;

at least one substantially horizontal hydraulic cylinder extending substantially perpendicular to said at least two substantially horizontal hydraulic cylinders; and means for attaching said at least two and said at least one substantially horizontal hydraulic cylinders between said platform and said underframe.

5. An earthquake simulator according to claim 1 wherein said means for providing pressurized oil comprises;

a pressure vessel containing oil;

a compressed gas;

means for pressurizing said oil using said compressed gas; and means for connecting said pressure vessel to said hydraulic cylinders.

6. An earthquake simulator according to claim 5 wherein said compressed gas is nitrogen.

7. An earthquake simulator according to claim 1 further comprising at least one building construction affixed to said platform which can undergo a simulated collapse movement.

8. An earthquake simulator according to claim 1 wherein each hydraulic cylinder includes a piston rod which projects into a cylinder which is connected to a pressure vessel.

9. An earthquake simulator according to claim 1 wherein the center of gravity of the platform coincides approximately with the center of gravity of the triangle.

* * * * *